United States Patent [19]

Gottfried

[11] Patent Number: 4,703,188

[45] Date of Patent: Oct. 27, 1987

[54] POWER SOURCE FOR STARTER MOTORS

[75] Inventor: Mario H. Gottfried, Mexico City, Mexico

[73] Assignee: Power Group International Corp., Houston, Tex.

[21] Appl. No.: 499

[22] Filed: Jan. 5, 1987

[51] Int. Cl.[4] ..... F02N 11/04

[52] U.S. Cl. ..... 290/38 B; 123/179 J

[58] Field of Search ..... 290/38 R, 38 B, 48; 123/179 C, 179 D, 179 J, 179 P, 179 AS

[56] References Cited

U.S. PATENT DOCUMENTS

| | | | |
|---|---|---|---|
| 1,718,424 | 6/1929 | McGrath | 290/38 B |
| 1,855,281 | 4/1932 | Chilton | 290/38 B |
| 2,346,303 | 4/1944 | Heintz | 290/38 B |
| 2,349,867 | 5/1944 | Heintz | 290/38 B |
| 2,877,755 | 3/1959 | Danilewicz | 123/179 J |
| 4,233,521 | 11/1980 | Pouget | 290/38 B |

*Primary Examiner*—William M. Shoop, Jr.
*Assistant Examiner*—W. E. Duncanson, Jr.
*Attorney, Agent, or Firm*—Dula, Shields & Egbert

[57] ABSTRACT

A power source for a starter motor comprising a frame, a hand crank rotatably connected to the frame, a flywheel generator connected to the hand crank, and power transmission electrically connected to the flywheel generator so as to transmit energy to a starter motor. The flywheel generator comprises a flywheel connected to the hand crank, a permanent magnet fixedly attached to the flywheel, and a stator winding mounted to the frame. The stator winding is electrically connected to the power transmitter. The power transmitter includes a rectifier bridge electrically connected to the flywheel generator and connector leads for connecting the rectifier bridge to terminals associated with a starter motor. A gear train is arranged within the frame so as to transmit a greater rate of rotation to the flywheel.

18 Claims, 1 Drawing Figure

POWER SOURCE FOR STARTER MOTORS

TECHNICAL FIELD

The present invention relates to power sources in general. More particularly, the present invention relates to apparatus for the replacement of batteries used for starting internal combustion engines.

BACKGROUND ART

In automobiles, the source of electrical energy for the various electrical devices of the automobile is the generator, or dynamo. It is belt driven from the engine crankshaft. The generator is usually a two-pole, direct-current type with a field controlled by a voltage regulator the function of which is to match the generator output to the electrical load and also the charging requirements of the battery, regardless of engine speed. High-wattage electrical loads, resulting from the addition of many electrical accessories, have made it increasingly difficult to design direct current generators with sufficiently high capacity to maintain the battery in a fully charged condition.

A lead-acid battery serves as a reservoir to store excess output of the generator by chemical changes in the sulfuric acid electrolyte and in the composition of the lead plates. Energy for the starting motor is thus made available, along with power for operating other electrical devices, when the engine is not running or when the generator speed is not sufficiently high to carry the load.

The starting motor drives a small spur gear so arranged that it automatically moves into mesh with gear teeth on the rim of the flywheel as the starting-motor armature begins to turn. When the engine starts, the small gear is disengaged, thus preventing damage to the starting motor from overspeeding. The starting motor is designed for high current consumption and delivers considerable power for its size for a limited time.

The combination of batteries and starting motor is used in a wide variety of vehicles. These are often employed on a wide variety of internal combustion engine operations.

The United States Army has recently stated that one of their biggest problems in the reliability of field generators were "dead batteries and generator units that failed to function properly." In the field operations, it was often possible to have major failures because of the inoperability of these generators and/or batteries. There was also no manual alternative to the use of these batteries and/or generators.

It is an object of the present invention to provide a power source for a starter motor that is a portable and an independent ready source of DC power.

It is another object of the present invention to provide a power source that can substitute for automotive storage batteries.

It is a further object of the present invention to provide a power source that is sufficiently light and small for easy transportation.

These and other objects and advantages of the present invention will become apparent from a reading of the attached specification and appended claims.

DISCLOSURE OF THE INVENTION

The present invention is a power source for a starter motor that comprises a frame, a hand crank rotatably connected to the frame, a flywheel generator connected to the hand crank, and a power transmitter electrically connected to the flywheel generator. The flywheel generator creates an energy output relative to the rotation of hand crank. The power transmitter transmits energy from the flywheel generator to the starter motor. The power transmitter is for the purpose of converting the energy output of the flywheel generator into a DC voltage.

The hand crank of the present invention comprises a handle, an arm rotatably connected to the handle, and an axle affixed to one end of the arm. The other end of axle is connected to the flywheel generator. The axle is rotatably mounted in the frame of the present invention. The handle has a bore extending therethrough. The arm has a pin member that is fixably fastened thereto and extends freely through the bore of the handle.

The frame of the present invention comprises of base, an upright member connected to the base and a support member fixedly mounted to upright member and extending outwardly therefrom. The hand crank is rotatably mounted to the upright member and to the support member. The base has a plurality of holes for enabling the base to be fixedly mounted to an adjacent surface. A plurality of bolts connect the support member to the upright member.

The flywheel generator comprises a flywheel that is connected to the hand crank, a permanent magnet fixedly attached to the flywheel, and a stator winding mounted to the frame. The flywheel is connected to the hand crank so as to rotate upon the movement of the hand crank. The stator windings are mounted to the frames so as to pass an energy output to the power transmitter. The permanent magnet is attached to the flywheel so as to be adjacent to the stator winding on the frame. The stator winding is a three-phase winding.

The power transmitter comprises a rectifier bridge electrically connected to the flywheel generator and a connector that is electrically connected to the rectifier bridge. The rectifier bridge converts the energy output of the flywheel generator into a DC voltage. The connector transmits the DC voltage to the starter motor. The power transmitter further comprises a housing that is affixed to the frame. This housing contains the rectifier bridge. The connector is electrically connected to the rectifier bridge in the housing and extends from the housing. The connector comprises a positive electrical lead connected to the rectifier bridge and having a clamp on one end for attaching to the positive terminal of a starter motor, and a negative electrical lead for attaching to the ground terminal of the starter motor. The positive electrical lead has one end that is connected to a push-button solenoid. The solenoid is electrically connected to the positive terminal of the starter motor. The push-button solenoid selectively causes current to pass to the starter motor.

The present invention further comprises a gear train that is connected to the hand crank and to the flywheel generator. This gear train causes the flywheel of the flywheel generator to rotate at a rate greater than the rate of rotation of the hand crank. The gear train comprises a first gear that is fixedly attached to a first axle of the hand crank, a second axle rotatably mounted in the frame, a first pinion mounted on the second axle, a second gear mounted on the second axle, and a second pinion mounted on a third axle. The first gear is mounted so as to rotate at a rate equal to the rate of rotation of the hand crank. The first pinion is mounted on the second axle so as to engage the teeth of the first gear. The second gear has a larger diameter than the first pinion. The second pinion engages the teeth of the second gear. The second pinion is connected to the flywheel of the flywheel generator such that the flywheel rotates at the rate of the second pinion. The second pinion is fastened over a third axle which is fixedly attached to the center of the flywheel. This third axle has an inner bore that receives an end of the first axle. This first axle passes through the center of the second pinion. The first and third axles are rotatable relative to each other. The third axle is rotatably mounted to the frame. The flywheel is attached to the third axle by a threaded member extending through the flywheel to the center of the end of the third axle. The first pinion has a smaller diameter than the first gear. The second axle is parallel to the first axle within the frame. The first, second, and third axles are rotatably mounted within ball-bearing sets in the frame.

BEST MODE FOR CARRYING OUT THE INVENTION

Figure 1:
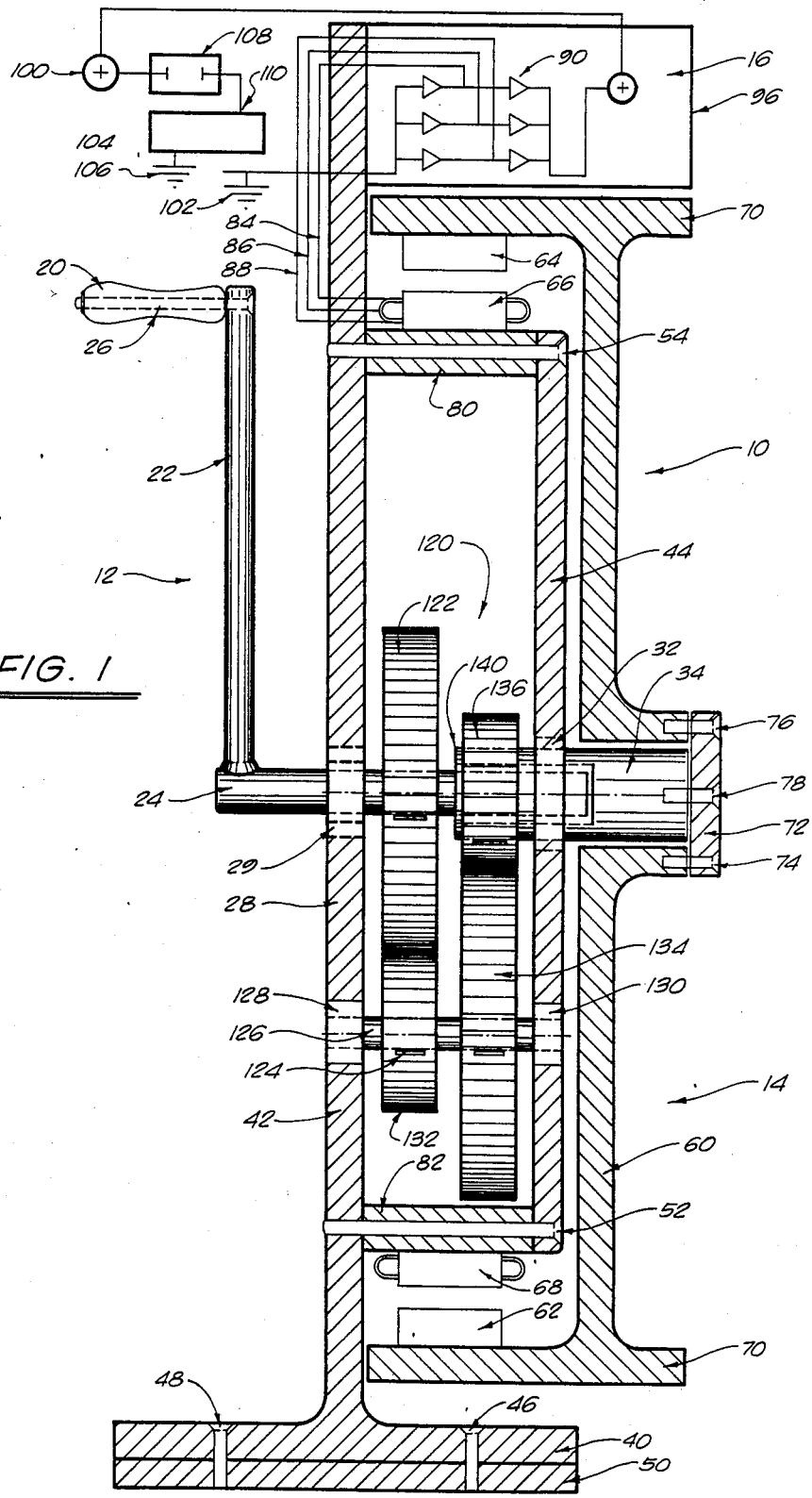
FIG. 1 is a cross-sectional view in side elevation of the preferred embodiment of the present invention.

Referring to FIG. 1, there is shown a cross sectional view, and partially schematic view, of the power source 10 for starter motors. Power source 10 includes hand crank 12, flywheel generator 14, and power transmitter 16. Each of these elements combine so as to produce power for the starting of internal combustion engines.

The hand crank 12 comprises a handle 20, an arm 22, and an axle 24. The handle 20 may be a wooden or plastic handle having a bore extending through the middle of the handle. A pin 26 extends through the bore of handle 20 and is rigidly affixed, by threads or other means, to arm 22. Pin 26 extends freely through the bore of handle 20 so that handle 20 rotates freely with respect to pin 26 and arm 22. Pin 26 is at a ninety-degree angle with respect to arm 22. Handle 20 has a configuration that is suitable for a human grip. Arm 22 is a rigid member that extends from the handle 20 to the axle 24. Arm 22 is rigidly affixed to one end of axle 24. Arm 22 serves to impart the motion from handle 20 onto axle 24 and to provide proper leverage for human operation. Axle 24 is a cylindrical member that is attached to arm 22 at one end and at the other end to the flywheel generator 14. Axle 24 is rotatably mounted to frame 28. This rotatable mounting is accomplished by extending axle 24 through ball-bearing set 29 attached to frame 28. This ball-bearing set 29 is of a standard type and allows the free rotational movement of axle 24 within the ball-bearing set 29. Ball-bearing set 29 is fixedly mounted to frame 28. The other end of axle 24 is similarly rotatably mounted withing a ball-bearing set 32. Ball-bearing set 32 will also include another axle 34, to be described hereinafter.

Frame 28 comprises a base 40, an upright member 42, and a support member 44. The upright member is integrally formed and connected to base 40. Support member 44 is fixedly connected to the upright member 42 and extends outwardly therefrom. As can be seen in FIG. 1, axle 24 is rotatably mounted in both upright member 42 and support member 44. Base 40 has a plurality of holes 46 and 48. Holes 46 and 48 enable base 40 to be fixedly mounted to an adjacent surface 50. Bolts, or other threaded members, can be appropriately inserted in holes 46 and 48 so as to secure base 40 to a surface 50. Support member 44 has a C-shaped configuration. Since support member 44 is a separate member from upright member 42, support member 44 is attached to upright member 42 by bolts 52 and 54. Bolts 52 and 54 extend from one side of support member 44, through the arms of support member 44, into and through upright member 42. The arrangement of bolts 52 and 54 in combination with the support member 44 and the upright member 42 provide a secure structural arrangement for the power source of the present invention. These also add extra structural integrity to the rotatable mounting arrangements related to axle 24.

The flywheel generator 14 of the present invention comprises a flywheel 60, permanent magnets 62 and 64, and stator windings 66 and 68. Flywheel 60 is connected to the hand crank arrangement 12. In particular, flywheel 60 is connected to hand crank 12 through a gear train arrangement, to be described hereinafter. Flywheel 60 has a circular configuration and an inwardly extending end 70. Flywheel 60 is connected to the hand crank so as rotate upon the movement of the hand crank. In particular, flywheel 60 is connected to axle 34 by way of end cap 72. End cap 72 has bolts 74 and 76 rigidly affixing the end caps 72 to the flywheel 60. End cap 72 also has threaded member 78 extending into axle 34 so as to secure the arrangements between the flywheel generator 14 and the hand crank 12.

Permanent magnets 62 and 64 are fixedly mounted to the inward end 70 of flywheel 60. Permanent magnet 62 and 64 are positioned so as to be adjacent to stator windings 66 and 68. For the operation of the present invention, it is important that the permanent magnet 62 and 64 pass, in close proximity, to the stator windings 66 and 68. Stator windings 66 and 68 are mounted to the outward side of arms 80 and 82 of support member 44. The stator windings are three-phase windings. Stator windings 66 and 68 are placed so as to be stationary with respect to the permanent magnet 62 and 64. Stator windings 66 and 68 are electrically connected to the power transmitter 16 so as to pass an energy output to the power transmitter. In essence, the rotation of the permanent magnet in close proximity to the stator windings will cause energy to be produced in relation to the rate of magnetic fluctuations in the field of the stator windings.

Stator windings 66 and 68 are connected to the power transmitter 16 by lines 84, 86, and 88. These lines 84, 86, and 88 pass the energy output of the flywheel generator 14 to the power transmitter 16.

Power transmitter 16 comprises a rectifier bridge 90. Rectifier bridge 90 is a standard arrangement of diodes that convert the alternating current produced by the rotation of the flywheel generator 14 into a direct current. This configuration of the rectifier bridge is known by the prior art. Since the power generated by the present invention must be passed to a DC starter motor, it is important that the energy output be direct current.

Connector 94 is electrically connected to rectifier bridge 90 and serves to transmit the DC voltage to the starter motor. A housing 96 is rigidly affixed to the upright member 42 of frame 28. This housing contains the rectifier bridge 90. The housing 96 is stationary and rigidly positioned in place. Connector 94 is electrically connected to the rectifier bridge 90 and extends outwardly through an opening in housing 96. Connector 94 has a positive electrical lead 100 and a negative electrical lead 102. The positive electrical lead 100 is connected to the rectifier bridge and has a clamp on the end opposite the rectifier bridge for attaching to the positive terminal of a starter motor 104. The negative electrical lead 102 is attached to the ground terminal or other grounding connection 106.

For the operation of the present invention, the positive electrical lead is connected to push-button solenoid 108. The solenoid is electrically connected to the positive terminal 110 of starter motor 104. Push-button solenoid 108 serves to cause current to pass from the power source 10 to the starter motor 110. Push-button solenoid 108 may also contain signal mechanisms that allow the operator of the power source 10 to determine when a sufficient charge has been built up. The push-button solenoid 108 may then be activated so as to close the circuit from the power source 10 to the starter motor 110. This serves to deliver a surge of DC power so as to crank the engine associated with the starter motor and thus, starting the engine.

A gear train arrangement 120 is connected to the hand crank 12 and to the flywheel generator 14. This gear train 120 causes the flywheel 60 of the flywheel generator 14 to rotate at a rate greater than the rate of rotation of the hand crank 12. Gear train 120 includes a first gear 122 that is fixedly attached to axle 24 of hand crank 12. This first gear 122 is mounted so as to rotate at a rate equal to the rate of rotation of the hand crank. Gear 122 is fixedly mounted so as to extend radially from axle 24. Gear 122 is rigidly attached at 124 by welding, or other connection means. Gear train 120 also includes a second axle 126. Second axle 126 is rotatably mounted in ball-bearing sets 128 and 130 in the frame 28. Specifically, ball-bearing set 128 is attached to the upright member 42 of frame 28. The other ball-bearing set 130 is mounted onto support member 44 of frame 28. The ends of axle 126 are received by these ball-bearing sets so that the axle 126 rotates freely therein. A first pinion 132 is mounted on the second axle 126 such that the teeth of pinion 132 engage the teeth of first gear 122. First pinion 132 extends radially outward from second axle 126. The arrangement of first gear 122 and first pinion 132 causes first pinion 132 to rotate at a greater rate than the rate of rotation of first gear 22. In other words, first pinion 132 has a smaller diameter than the first gear 122. The second axle 126 is mounted so as to be parallel with the first axle 24.

Gear train 120 includes a second gear 134 fixedly mounted to second axle 126. Second gear 134 has a larger diameter than the first pinion 132. Second gear 134 is mounted on second axle 126 on the side of first pinion 132 adjacent support member 44. The configuration of first pinion 132 and second gear 134 is such as to cause the radial velocity of second gear 134 to be greater than the radial velocity of either first gear 122 or first pinion 132.

Gear train 120 also includes a second pinion 136 that engages the teeth of second gear 134. Second pinion 136 is mounted to a third axle 34 and, in turn, the flywheel 60 of the flywheel generator 14. This configuration causes flywheel 60 to rotate at the same rate as second pinion 136. Second pinion 136 has a smaller diameter than second gear 134. Second pinion 136 is fastened over third axle 134. This third axle is fixedly attached by threaded member 78 to the center of flywheel 60. In particular, third axle 34 attaches to the end cap 72 of flywheel 60. Third axle 34 has an inner bore 140 that receives the end of first axle 24 opposite arm 22. First axle 24 passes through the center of the second pinion 136. Both the first axle 24 and the third axle 34 are rotatable relative to each other. Third axle 34 is rotatably mounted to the support member 44 of frame 28.

Gear train 120 enables a relatively small amount of movement of hand crank 22 to cause a great amount of rotation in the flywheel 60. Insofar as a rate of rotation of between 500 and 1500 rpm could be required by the flywheel 60 in order to generate sufficient power to start an internal combustion engine, this gear train is necessary so as to enable the flywheel to achieve this rate of rotation. This further minimizes the effort required to turn the hand crank 12 so as to provide the necessary starting ability. It must be noted here that although a gearing arrangement is specified with respect to gear train 120, the present invention could also employ rubber friction gears or other arrangements of gear-type members so as to provide the function of gear train 120.

The power source 10 of the present invention serves as a backup, hand-cranked, inertial generator unit for engaging and starting DC starter motors for internal combustion engines. In other words, the present invention operates as a "battery substitue". The present invention represents a valuable tool because there is a need for a portable and independent ready source of DC power wherever electrical motor starting is required. The present invention is intended primarily as a substitute for automotive storage batteries when the batteries are dead, missing, damaged, and/or insufficiently charged. The present invention is equipped with a hand crank for manually accelerating the generator rotor permanent magnet field and flywheel by way of an integral step-up gear train. The present invention stores kinetic energy so as to provide for a brief, but sufficient, power to crank the DC starter motor on an internal combustion engine. The generator delivers a rectified DC voltage and current that is connectable and commensurate with commercial and automotive cranking batteries. The present invention may be made in various sizes for applying to the various ranges of DC engine starter motors. For example, a larger unit might be required for starting the engine of heavy equipment. On the other hand, much smaller arrangements could be established for the purpose of starting small engines such as motorcycles and small automobiles. The generator can provide DC reconnectable power for 12 volts, 24 volts, 32 volts, or otherwise. The power source 10 can also serve as a DC generator by itself.

In operation, the power source 10 is taken to the point of usage. At the point of usage, it may be attached as standard equipment to a vehicle or to some other surface so as to provide stability during the cranking operation. The mounting arrangement 40 of the present invention allows the unit to be stabilized. Alternatively, various clamping devices could be used so as to make the present invention steady. There are two integral cable leads that allow the unit to be attached to the terminals of an engine starter.

Operation begins when the hand crank 12 is turned and accelerated manually until a sufficient kinetic energy is stored (and indicated on apparatus 108) to engage the starter and kick over the engine. The hand cranking may be interrupted or continued for added energy when the starter is engaged. The unit may be activated, turned, and accelerated manually as often as required.

The present invention should have a somewhat "pancake" appearance. This allows the unit to be sufficiently light and small for easy transportation. This unit may be provided with a variety of mounting arrangements. The type described in connection with FIG. 1 is but one style of mounting arrangement that can be employed. It is important that the insulated cable leads 94 and 102 be marked for polarity. Small labels could be applied to the clamping mechanisms connected to these leads so as to provide a visual indication of the proper connecting arrangement.

The present invention does not require strenuous hand cranking. Cranking should continue for about 30 to 60 seconds so as to provide for ample acceleration. The hand crank may be equipped with a mechanical release for safety purposes. Alternatively, a clutching mechanism could be provided where the handle would not continue to rotate with the rotation of the flywheel.

If the person operating the unit has sufficient desire, it would be possible to manually charge a dead or low battery. It is not critical to the use of the present invention that the present invention be attached directly to the starter motor. If needed, the present invention could be directly connected to the battery so as to charge the battery and, in turn, allow the battery to charge the starter motor.

The foregoing disclosure and description of the invention is illustrative and explanatory thereof, and various changes in the details of the illustrated apparatus may be made within the scope of the appended claims without departing from the true spirit of the invention. The present invention should only be limited by the following claims and their legal equivalents.

I claim:

1. A power source for a starter motor comprising:

a frame:

hand crank means rotatably connected to said frame;

flywheel generator means connected to said hand crank, said flywheel generator means for creating an energy output relative to the rotation of said hand crank means; and, power transmission means electrically connected to said flywheel generator means for transmitting energy from said flywheel generator means to said starter motor, said power transmission means for converting said energy output of said flywheel generator means into a DC voltage.

2. The power source of claim 1, said hand crank means comprising:

a handle;

an arm rotatably connected to said handle; and an axle affixed to one end of said arm, said axle connected at the other end to said flywheel generator means, said axle rotatably mounted to said frame.

3. The power source of claim 2, said handle having a bore extending therethrough, said arm having a pin member fixedly fastened thereto and extending freely through said bore of said handle at a ninety degree angle relative to said arm.

4. The power source of claim 1, said frame comprising:

a base;

an upright member connected to said base; and a support member fixedly mounted to said upright member and extending outwardly therefrom, said hand crank means rotatably mounted to said upright member and said support member.

5. The power source of claim 4, said base having a plurality of holes for enabling said base to be fixedly mounted to an adjacent surface, and a plurality of bolts connecting said support member to said upright member.

6. The power source of claim 1, said flywheel generator means comprising:

a flywheel connected to said hand crank means, said flywheel connected to said hand crank so as to rotate upon the movement of said hand crank;

a permanent magnet fixedly attached to said flywheel; and stator means mounted to said frame for passing said energy output, said stator means electrically connected to said power transmission means.

7. The power source of claim 6, said permanent magnet attached to the outer portion of said flywheel so as to be adjacent said stator means on said frame.

8. The power source of claim 6, said stator means having threephase winding.

9. The power source of claim 1, said stator power transmission means comprising:

a rectifier bridge means electrically connected to said flywheel generator means for converting said energy output of said flywheel generator means into a DC voltage; and connector means electrically connected to said rectifier bridge means for transmitting said DC voltage to said stator motor.

10. The power source of claim 9, said power transmission means further comprising:

a housing affixed to said frame, said housing containing said rectifier bridge means, said housing being stationary, said connector means electrically connected to said rectifier bridge means in said housing and extending from said housing.

11. The power source of claim 10, said connector means comprising:

a positive electrical lead connected to said rectifier bridge means and having a clamp on the end opposite said positive electrical lead, said positive electrical lead for attaching to the positive terminal of said starter motor; and a negative electrical lead connected to said rectifier bridge means and having a clamp on the end opposite said rectifier bridge means, said negative electrical lead for attaching to the ground terminal of said starter motor.

12. The power source of claim 1, further comprising:

gear train means connected to said hand crank means and said flywheel generator means, said gear train means for causing a flywheel of said flywheel generator means to rotate at a rate greater than the rate of rotation of said hand crank means.

13. The power source of claim 12, said gear train means comprising:

a first gear fixedly attached to a first axle on said hand crank means, said first gear mounted so as to rotate at a rate equal to the rate of rotation of said hand crank means;

a second axle rotatably mounted in said frame;

a first pinion mounted on said second axle so as to engage the teeth of said first gear;

a second gear mounted on said second axle, said second gear having a larger diameter than said first pinion; and a second pinion engaging the teeth of said second gear, said second pinion connected to said flywheel of said flywheel generator means such that said flywheel rotates at the rate of said second pinion.

14. The power source of claim 13, said second pinion fastened over a third axle, said third axle fixedly attached to the center of said flywheel of said flywheel generator means.

15. The power source of claim 14, said third axle having an inner bore for receiving an end of said first axle, said first axle passing through the center of said second pinion, said first and third axles rotatable relative to each other.

16. The power source of claim 15, said third axle rotatably mounted to said frame, said flywheel attached to said third axle by a threaded member extending through said flywheel to the center of the end of said third axle.

17. The power source of claim 13, said first pinion having a smaller diameter than said first gear, said second axle being parallel to said first axle within said frame, said second axle rotatably mounted within a ball bearing set in said frame.

18. The power source of claim 10, said power transmission means comprising a positive electrical lead having one end connected to a push-buttonsolenoid, said solenoid being electrically connected to the positive terminal of said starter motor, said push-button solenoid for selectively causing current to pass to said starter motor.

* * * * *